US005318677A

United States Patent [19]

Hirbour et al.

[11] Patent Number: 5,318,677

[45] Date of Patent: Jun. 7, 1994

[54] PROCESS AND SOLUTIONS FOR REMOVING RESIN BLEED FROM ELECTRONIC COMPONENTS

[75] Inventors: Louis J. Hirbour, Yorba Linda; Heinz W. Schlenker, Northridge, both of Calif.; Earl J. Fadgen, Jr., East Greenwich, R.I.

[73] Assignee: Future Automation, Inc., Simi Valley, Calif.

[21] Appl. No.: 853,405

[22] Filed: Mar. 18, 1992

Related U.S. Application Data

[63] Continuation-in-part of Ser. No. 640,053, Feb. 13, 1991, Pat. No. 5,186,797.

[51] Int. Cl.[5] ..... C25F 1/00

[52] U.S. Cl. ..... 204/141.5; 204/129.95

[58] Field of Search ..... 204/141.5, 146, 129.91

[56] References Cited

U.S. PATENT DOCUMENTS

| | | | |
|---|---|---|---|
| 4,174,269 | 11/1979 | Carlin et al. | 204/129.95 |
| 4,781,804 | 11/1988 | Wolf | 204/141.6 |
| 4,966,664 | 10/1990 | Buerk et al. | 204/146 |
| 4,968,397 | 11/1990 | Asher et al. | 204/141.5 |
| 4,968,398 | 11/1990 | Ogasawara | 204/146 |
| 5,186,797 | 2/1993 | Schlenker et al. | 204/146 |

*Primary Examiner*—Donald R. Valentine
*Attorney, Agent, or Firm*—Hale and Dorr

[57] ABSTRACT

A process and solution is disclosed for removing resin bleed from leads of an encapsulated electronic component in which the component is positioned in an aqueous bath having dissolved therein glycerol and a phosphate salt selected from the group consisting of an alkali metal or ammonium phosphate, polyphosphate or pyrophosphate salt. The component is cathodically connected in an electric circuit enabling electrical current to pass through said component.

29 Claims, 6 Drawing Sheets

PROCESS AND SOLUTIONS FOR REMOVING RESIN BLEED FROM ELECTRONIC COMPONENTS

CROSS REFERENCE TO RELATED APPLICATION

This application is a continuation-in-part of U.S. patent application Ser. No. 640,053 filed Feb. 13, 1991, now U.S. Pat. No. 5,186,797, entitled "Method and System for Removing Resin Bleed from Electronic Components"

FIELD OF INVENTION

This invention relates to a process for manufacturing electronic components and more particularly to a process and solution for removing the resin-bleed from the leads of electronic components.

BACKGROUND OF THE INVENTION

Since the early 1970's delicate electronic components (such as integrated circuit chips) have been encapsulated in electrically insulating bodies from which protrude only contact elements necessary to communicate to other portions of a completed circuit. It is particularly advantageous to create such insulating bodies by molding the components to be protected into a thermoset plastic resin. The resin, however, often coats more than the electronic circuit or drips onto the leadframe of the electronic circuits. In other words, this resin ends up coating part of the leads for the electronic circuit, and such excess resin is referred to herein as "resin-bleed". This resin-bleed may exist as a thick, visible residue attached to the electronically insulated resin body, often also referred to as "mold-flash", or it may exist as a very thin, almost invisible residue either attached to or separate from the electrically insulated resin body. This latter described condition is particularly insidious because of its invisible nature. Resin-bleed in whatever form must be removed from the leads prior to any later manufacturing processes, such as the plating of the leads.

DESCRIPTION OF PRIOR ART

Various methods for removing resin bleed have been tried. Chemical deflashing uses a chemical solution which will dissolve or otherwise remove the resin bleed from the leads. Traditionally, M-Pyrol has been used in chemical deflashing. Use of M-Pyrol, however, has been known to cause many in-house fires due to its flammability and high operating temperatures. Therefore, chemical deflashing has dangerous side effects. It also dissolves most resin residues but does not clean the lead frame, completely. Additional procedures such as mechanical brushing, high pressure water blast or even media blasting must be performed to remove plastic residues from the lead itself.

Another type of deflashing equipment has been used in which a high pressure liquid with a mixture of fine glass or sand media is sprayed at the leadframe in order to remove the resin bleed. This type of deflashing, which is known as "media deflashing" or "media blasting", however, also presents problems because the media gets imbedded in the leadframe, the media is expensive and the solution with the media is a contaminated solution which must be properly discarded. When foreign particles or even media particles are physically embedded in the lead, they can cause adhesion problems between the tin-lead coating and the lead substrate. In some extreme cases the tin-lead coating can then de-wet or fail to pass standard solderability tests. These tests are used in part by the semiconductor industry to determine the adequacy of the overall cleanliness of the lead surface prior to depositing the tin lead coating. Another problem with media deflash has been its inability to thoroughly clean the newer, very thin, lead components especially those with material thickness of under 4 mils (0.004 inches) and very fine, narrow leadframe spacing of under 0.010 inches.

During the 1980's, both chemical deflashing and media blasting were used either alone or in combination to remove resin bleed. In both types of systems, a significant amount of handling is required because the encapsulated electronic components are batch loaded into either type of system. Once the components are processed in such a system they are then generally taken to rinse stations and drying stations. This processing is therefore slow and requires human intervention to load the leadframes into the various other process stations.

It is therefore a principal object of the present invention to provide a process and solution for removing plastic resin bleed from a metallic leadframe of an electronic component following the molding of the component.

It is a further object of the present invention to provide a process and solution for removing resin bleed that is either a thick visible residue or is a thin, almost invisible, residue on their metallic leadframes.

A still further object of the present invention is to provide a process and solution for removing resin bleed from electronic components having leads with a thickness less than 4 mils and lead spacing of under 0.010 inches.

SUMMARY OF THE INVENTION

The present invention is an improved method of cathodically electrocleaning an electronic component having leads which are contaminated or coated with excess resin-bleed. As previously noted during the manufacture of plastic encapsulated lead frame components, some amount of resin-bleed covers the leads. The parts or electronic components may be in strip form or may be singular components. The parts are attached to a metal rack or more preferably a metal belt so as to automatically and continuously supply resin-bleed coated leads to the cleaning cell or may be placed in a basket or barrel such as is known to those skilled in the art of electrocleaning. The electronic components are then immersed in a cleaning solution and cathodically electrocleaned. The process rapidly and effectively loosens and removes excess plastic resin or resin-bleed from the contaminated leads without affecting the resin encapsulated electronic component itself or degrading the insulation capability of the plastic resin.

The solution of the present invention is an aqueous solution including a dissolved phosphate, polyphosphate or pyrophosphate salt. With cathodic electrolysis the phosphate, polyphosphate and pyrophosphate salts have an affinity to and react with the plastic resin bleed to solublize, break apart and lift the plastic resin bleed from the surface of the leads. Such resin bleed removal is unique to phosphate, polyphosphate and pyrophosphate electrolyte solutions. The described cleaning process will also not etch the metal lead surfaces in any way. There is a secondary benefit in that atomic hydrogen produced at the lead surface will also effectively remove metal oxides which could interfere with either adhesion of tin or tin-lead plated deposits to the leads or ultimately affect the solderability of the tin or tin-lead plated deposits on the leads.

The terms plate or plated are intended to describe various methods of covering one metal with another and are not limited to electrochemical deposition. Some examples of the terms plate or plated include but are not limited to electrochemical deposition, chemical deposition, vacuum deposition, galvanizing, vapor deposition, sputtering, or spraying.

These and other objects and features of the present invention will be more fully described below in connection with the various figures in which corresponding reference numerals refer to corresponding parts throughout the several views.

DETAILED DESCRIPTION OF THE PREFERRED EMBODIMENT

Figure 1:
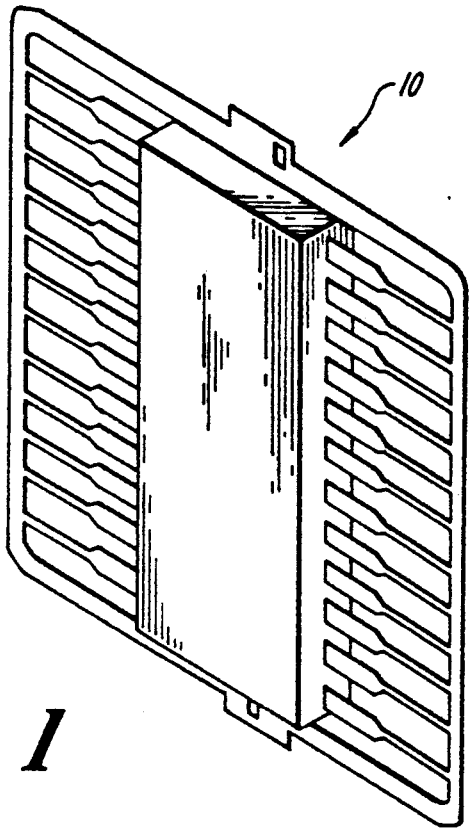
FIG. 1 is a perspective view of an encapsulated electronic component.
Figure 2:
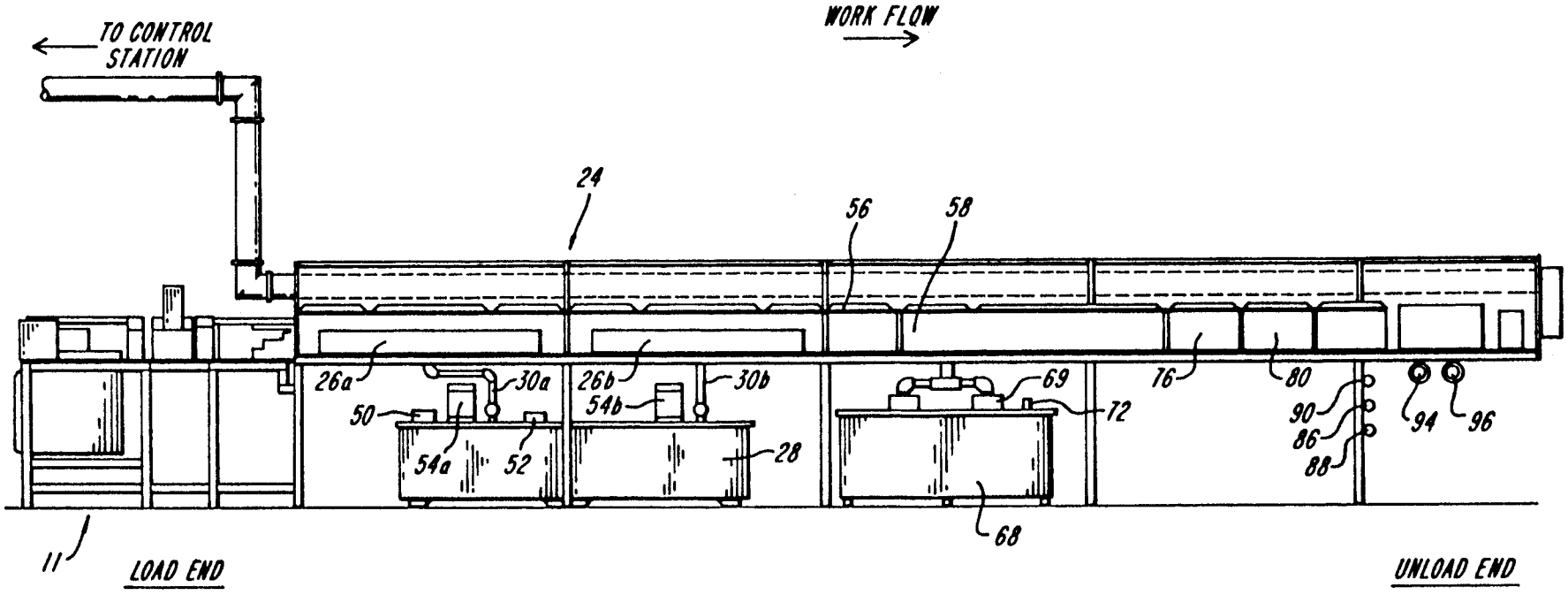
FIG. 2 is a front plan view of a preferred embodiment of the in-line system for removing resin bleed from the leadframe of an encapsulated electronic component of the present invention.

Referring to FIG. 2, the automatic deflash system used in the process of the present invention is fed electronic encapsulated components, an example of which is shown in FIG. 1, from either another component processing system when the deflash system is connected to such a system as part of a complete in-line system for molding semiconductor packages or from an operator when the deflash system is used as a stand alone unit.

The encapsulated electronic components 10 are loaded in the load station 11 onto a continuous conveyor belt 12 which will transport the components 10 throughout the entire system. The belt may be of any type traditionally used in connection with the production of encapsulated electronic circuits. In a preferred embodiment the belt 12 is an endless belt propelled in a continuous aligned loop. The belt proper 14 is constructed from a metallic alloy, preferably a stainless steel with high yield strength which is shaped into a flat web of considerable length, minimal thickness and a width adapted to the particular system. The web is formed into a continuous conveyor belt with its width in a substantially vertical plane. The bottom of the conveyor belt is provided with grip means 16, comprised of adjacent, double-bent fingers 18 of alternating asymmetrical shape which can interact to grip planar components pressed between adjacent flexible grip fingers. A belt of this type is described in detail in U.S. Pat. No. 4,534,843, the teachings of which are incorporated herein by reference.

The encapsulated electronic components 10 are then sequentially carried through a series of in-line process stations which remove resin bleed from the leadframes and then clean and dry the leadframe. The first such process station is the electrolytic deflash station 24, which in the embodiment shown in FIG. 2 is made up of a first electrolytic deflash cell **26*a* and a second electrolytic deflash tank 26*b*. Deflash cells 26*a*, 26*b* are fed an electrolytic solution from a solution reservoir 28 through feed pipes 30*a*, 30*b*. The reservoir 28 is dedicated solely to supplying electrolytic solution to the deflash cells 26*a*, 26*b***, and the reservoir recirculates the solution and heats it as well.

In a preferred embodiment, the solution used in the electrolytic deflash cells **26*a*, 26*b*** is a solution of alkali metal or ammonium phosphate or pyrophosphate added to water to form a conductive solution. In actual practice the concentration of the phosphate salt ranges from 0.1 weight percent to 50 weight percent. The bath preferably contains water from 50 to 99 weight percent. Baths used in the practice of this invention can be produced by mixing together either the individual salt components with water or an electrocleaning concentrate containing the alkali metal or ammonium phosphate previously dissolved in water to the cleaner tank containing the appropriate amount of water.

Figure 5:
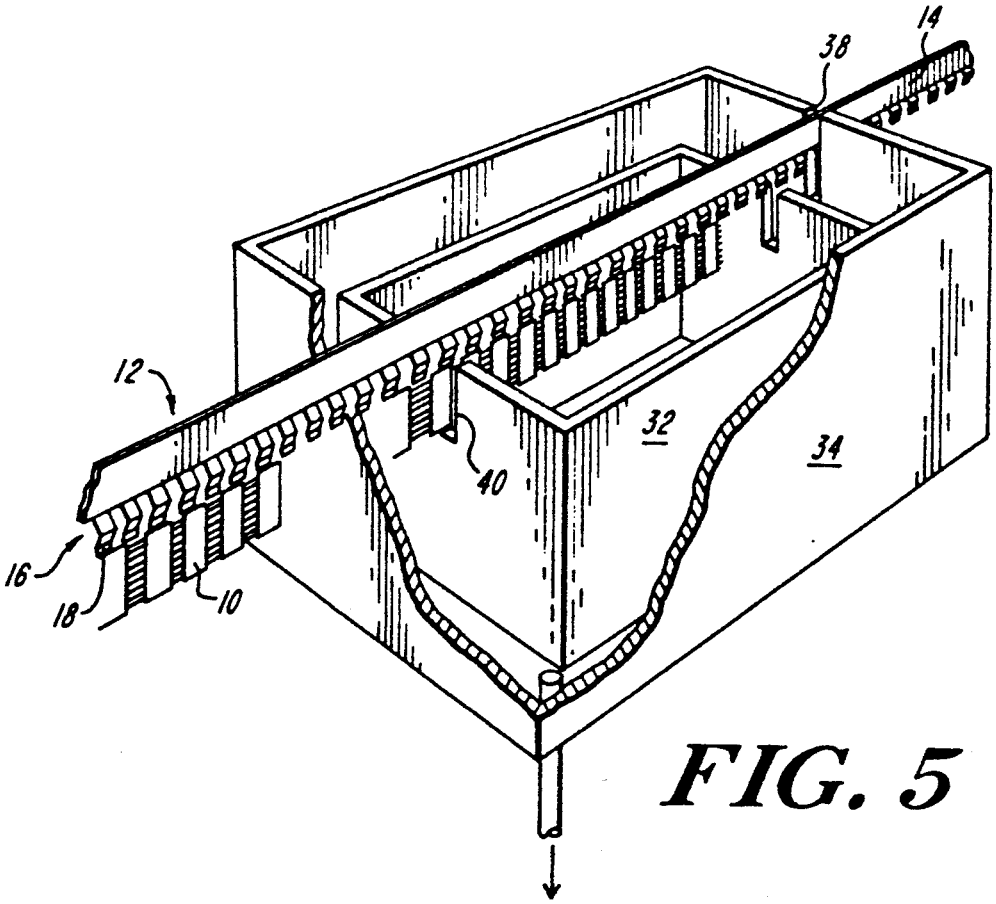
FIG. 5 is a perspective view of the electrolytic deflash station shown in FIGS. 3 and 4.
Figure 3:
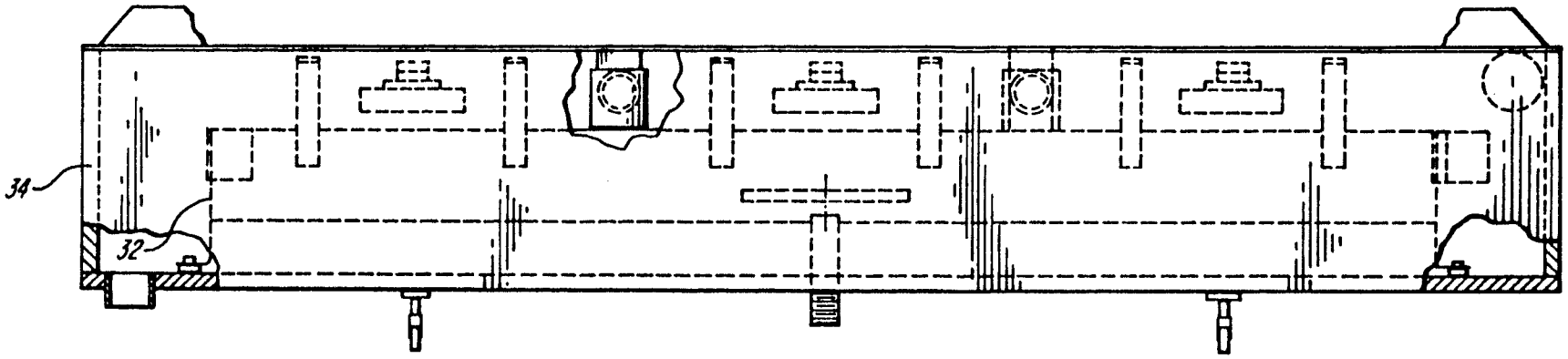
FIG. 3 is a side plan view of the electrolytic deflash cell of the system shown in FIG. 2.
Figure 4:
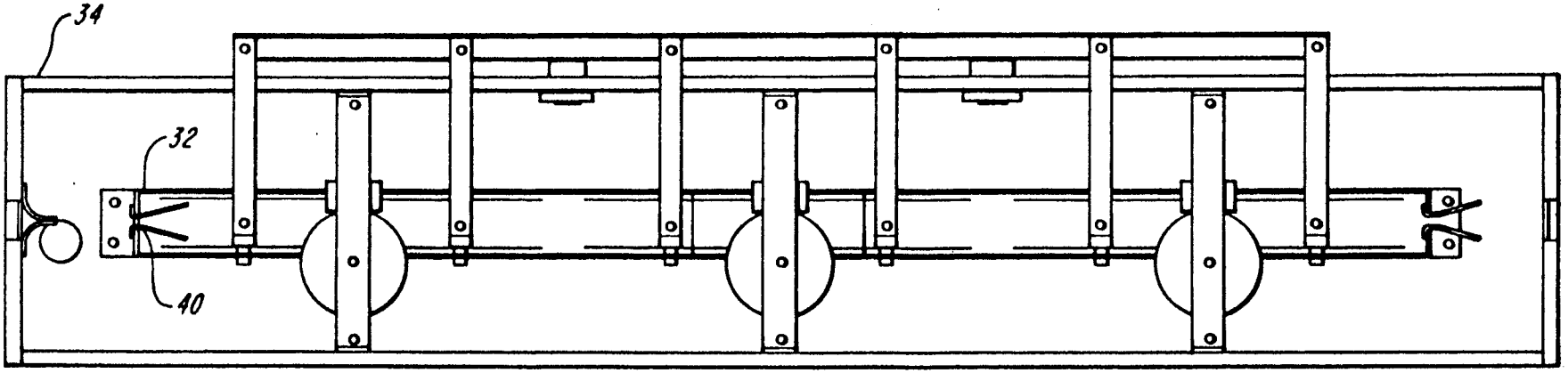
FIG. 4 is top view of the electrolytic deflash cell shown in FIG. 3.

The electrolytic deflash cells **26*a*, 26*b*, shown in FIGS. 3–5, are made up of an inner cell 32 and an outer cell 34. The belt 12 carrying the encapsulated components 10 travels through an opening 38 in the outer cell 34 and runs superposed over a weir 40 at the entrance to the inner cell 32 allowing the components 10 suspended therefrom to pass through the inner cell 32 below the surface level of the deflash solution contained therein. A similar weir 40 at the opposite end of the inner cell 32** permits the exit of the conveyor and the carried components without a change in their vertical position.

The outer cell 34 acts as an overflow container for the inner cell 32. The deflash solution contained within inner cell 32 flows through the weirs into the outer cell 34 and by means of a conduit 42 to a recirculating pump **54*a*, 54*b*. The pump returns the fluid to the inner cell 32** after the deflash solution has been filtered. Pumping action also serves to maintain a high degree of agitation within the tank in order to insure the chemical uniformity of the deflash solution. A tank construction of this type is described in detail in U.S. Pat. No. 4,534,843 which has already been incorporated herein by reference.

In one embodiment, it has been determined that a leadframe will have to be immersed in the deflash solution for a minimum of 30 seconds in order to loosen the resin bleed. Depending upon the desired throughput, the deflash tanks must therefore be constructed of a length in the machine direction sufficient to enable the components to be immersed for a sufficient length of time. Due to manufacturing problems, it is often necessary to use two electrolytic deflash cells as shown in the preferred embodiment of FIG. 2. In this embodiment which has a desired throughput rate of 1200 units per hour the encapsulated electronic component is immersed in each cell for 18 seconds. The cells **26*a*, 26*b* are constructed to be five feet in length and the belt 12 travels ten inches in every three seconds. A new leadframe is loaded onto the belt every three seconds and therefore in the embodiment shown in FIG. 2** the component is actually immersed in the tank for a total of 36 seconds.

The gripper belt 12, which transports the component 10, becomes the cathodic connection while opposing metallic plates, submersed in the solution on both sides of the leadframe, serve as the anodic connection. A rectifier 46 in each cell supplies high amperage DC current, thereby causing the formation of hydrogen gas on the surface of the semiconductor leadframe by electrolytic action. The formation of these gases causes the plastic resin bleed from the molding operation to be loosened from the metallic leadframe.

As described above, the resin bleed loosening solution which is stored in the reservoir 28 is heated in the reservoir, preferably to a temperature in the range of 100°-180° F. Heater 50 is provided for this purpose. A level sensor 52 monitors the level of the solution in the reservoir 28 and circulation pumps **54*a* and 54*b* are used to pump the solution from the reservoir to the deflash cells 26*a*, 26*b*** respectively.

After the encapsulated electronic component 10 has passed through the electrolytic deflash stage of the system, it passes through a first rinse station 56 which rinses off any deflash solution remaining on component 10 or the carrier belt 12. In the preferred embodiment, the rinse station 56 includes a housing in which two opposing manifolds having four spray nozzles direct a liquid spray (preferably tap water) from the nozzles to the component leadframe to rinse off the deflash solution. The spray nozzle manifolds are fed by water supply lines at the facility where the system is installed, preferably at a regulated pressure of 30 psi.

Figure 6:
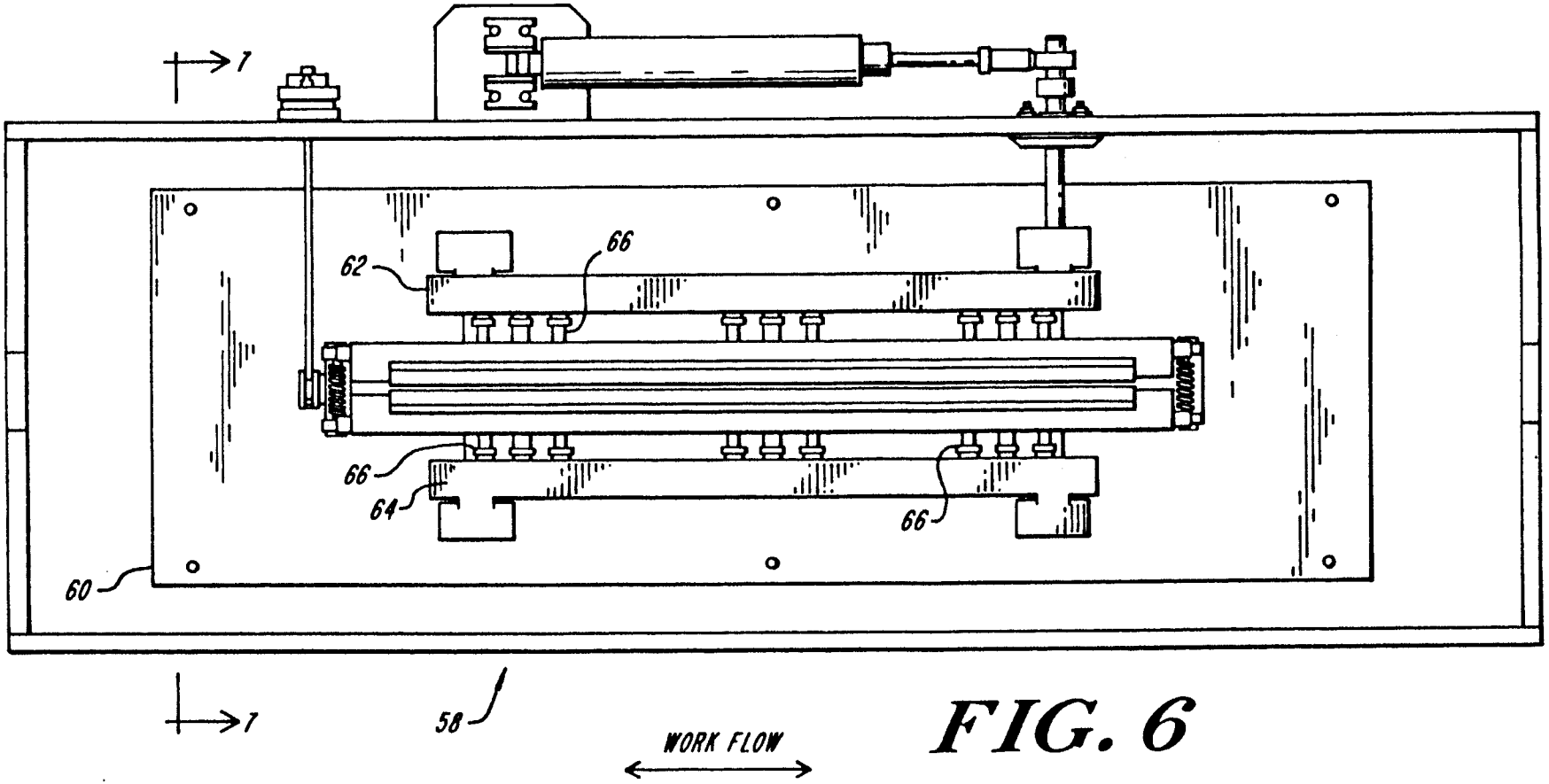
FIG. 6 is a top plan view of the high pressure rinse cell of the system shown in FIG. 2.
Figure 7:
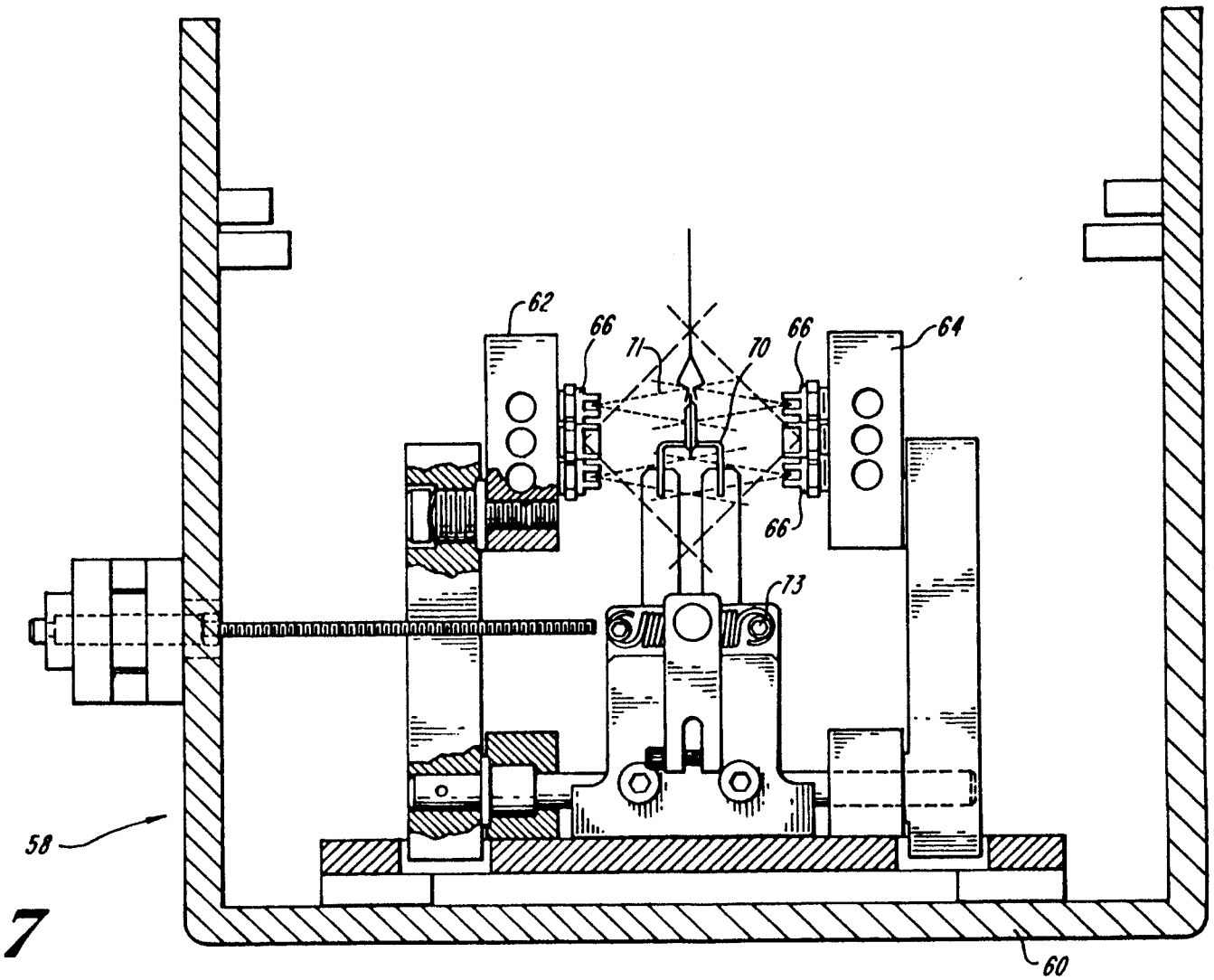
FIG. 7 is a sectional view taken along lines 7—7 of FIG. 6.

After passing through rinse station 56, the encapsulated electronic components 10 are then carried to a high pressure spray station 58 designed to remove the resin bleed and other excess material loosened in the electrolytic deflash station. In the preferred embodiment shown in FIGS. 6 and 7, the high pressure spray station 58 includes a housing 60 which includes two manifolds 62, 64 and twenty-four (24) spray nozzles 66 connected to the manifolds 62, 64 with twelve spray nozzles being connected to manifold 62 and twelve spray nozzles being connected to manifold 64. These manifold assemblies 62, 64 are supplied with water from a recirculating reservoir 68 which delivers water via a high pressure pump 69. In the preferred embodiment two such pumps 69 are provided for each manifold set and water is preferably delivered by these spray nozzles at 300 to 500 psi.

The lead frame 10 when travelling through station 58 is supported between the manifolds with either an adjustable guide or an adjustable clamp mechanism 70 which is adjusted by a screw 73. With the leadframe properly supported, the manifold assemblies mechanically oscillate in a horizontal plane to completely blanket the leadframe with high pressure spray 71 in order to remove the deflash solution and the plastic resin bleed loosened by the electrolytic deflash solution.

The high pressure pumps are preferably enclosed in a sound insulator housing to reduce noise and are plumbed with regulators to adjust the pressure and solenoid valves to interrupt the flow of high pressure water spray when the clamp mechanism 70 is open and component 10 is indexed another 10 inch step. The reservoir 68 is equipped with dual sediment filters to catch the removed resin and allow easy cleanout without process interruption. The reservoir 68 is further equipped with an automatic refill valve 72 to flush itself out on a regular basis to avoid collection of debris.

From the high pressure spray rinse station 58, the encapsulated electronic component 10 is then carried to a second spray station 76 which is intended to remove any particulate matter that may have settled back on the leadframes. This station 76, as in the case of first rinse station 56, includes a housing in which two opposing manifolds with four spray nozzles each are positioned so that the component passes between the manifold. The nozzles direct a spray of water at the leadframes to remove any loose deflash or particulate matter. The spray nozzle manifolds are fed by water supply lines at regulated pressure of 30 psi.

The encapsulated electronic components 10 travel from the spray rinse station 76 to a hot deionized water rinse station 80 in which a high purity rinse is used to remove any process residues still remaining on the leadframe. In the station, as in stations 56, 76, the liquid (which in this case is deionized water) is pumped at 30 psi and is fed to two opposing manifolds with four spray nozzles each. The deionized water will further clean the leadframe and will also facilitate drying. Finally, the use of deionized water leaves the leadframe "spot free."

After leaving the hot deionized water rinse station 80, the component 10 travels through air knife station 84 which includes five opposing curtains of air for blowing moisture off of the component. One pair of air nozzles supply air at 50 psi whereas the other four pairs of air nozzles supply air at 1 to 2 psi. Solenoid valves 86,88 are provided to control the supply of cold and hot deionized water, respectively, for use in the hot deionized rinse station, and a siphoning valve 90 is provided to control the tap water supply to the rinse station 56,76. Valve 91 provides compressed air.

Finally, the encapsulated electronic component 10 which still may include a small amount of moisture is carried through a hot air dryer 92 which completely dries the component prior to the unloading of the component from the belt 12. Two hot air dryers 94, 96 pump the hot air at approximately 250° F. into the dryer.

The component is now ready to be unloaded from the gripper belt 12 or will continue to travel into a plating system if a plating system is connected to the output end of the resin bleed removal system.

The following non-limiting examples describe a number of deflash solutions of the present invention.

EXAMPLE I

A bath used to electrolytically remove resin-bleed from the leads of an electronic component was prepared which included :

| | |
|---|---|
| Dipotassium phosphate | 80 g/l |
| Water | Balance |

An electronic component with resin bleed covering the metallic leads was immersed in the above solution after attaching the leads to a metal rack. As described above, the metal rack was made the cathode in an electrical circuit and gassing occurred immediately and the resin-bleed was removed from the lead surface. After the electronic component was rinsed in water and dried the lead surface was examined and found to be completely free from resin bleed.

EXAMPLE II

Another cleaning bath was prepared with the following formulation:

| | |
|---|---|
| Ammonium phosphate | 100 g/l |
| Water | Balance |

The electronic component was immersed in the above solution with the leads electrically connected such that the leads were made the cathode. After a short time the component was removed from the above solution, rinsed, dried and the lead surface found to be free of resin-bleed.

EXAMPLE III

Another cleaning bath was prepared with the following formulation:

| | |
|---|---|
| Potassium pyrophosphate | 140 g/l |
| Water | Balance |

In a similar manner an electrical component whose leads were covered with resin-bleed was made the cathode in an electrical circuit while immersed in the above solution. The electrical component was removed from the cleaning solution, rinsed, dried and the lead surface was found to be free of resin-bleed.

EXAMPLE IV

Several additional alkali metal or ammonium phosphate, polyphosphate or pyrophosphate salts were tested in a similar manner and found to be effective in removing resin-bleed from the metallic leads of an electrical component. These alkali metal or ammonium phosphate, polyphosphate or pyrophosphate salts were selected from the group consisting of phosphate, metaphosphate, hexametaphosphate, orthophosphate, polyphosphate, phosphate dibasic, phosphate monobasic, phosphate tribasic, pyrophosphate tetrabasic, tripolyphosphate all either as the anhydrous or hydrated form.

EXAMPLE V

The temperature of the cleaning solutions of Examples I-IV were varied from 60° F. to 212° F. While the preferred temperature range is 100°-180° F., in actual fact the cleaning solutions were effective within the range of 60° F. to 212° F.

EXAMPLE VI

Another embodiment of the improved cleaning solutions further include certain chemical components often called surfactants or detergents which are added to the basic resin-bleed cleaner. The addition of these detergents or surfactants has the effect of increasing the cleaning effect of the hydrogen gas bubbles which form at the cathode during the resin bleed removal step. This addition of surfactants or detergents increases the amount of gassing at the cathode and decreases the surface tension of the cleaning solution, thus decreasing the cleaning time required for resin-bleed removal. Examples of such detergents or surfactants, used either singularly or in combination, are octyle or nonyl phenoxy polyethoxy ethanols, modified polyglycol adducts, ethoxylated linear alcohols, substituted imidazoline carboxylates, amine polyglycol condensates, alkyl aryl polyethers alcohols, phosphate ester type, chloroblocked copolymers of ethylene and propylene oxide and poly (oxyethlene) poly (oxypropylene) block copolymers. Some commercial products representative of such surfactants or detergents are Triton X-100, Triton X-102, Triton X-114, Triton X-155, which can be obtained from Union Carbide Chemical & Plastics Co., Industrial Chemicals Div., Brij 30 (ICI Americas Inc.), Standapol LF (Henkel Corp./Emery Grp.), Emcol L (Witco Corp., Organics Div.), Amphoterge J2 (Lonza Inc.), Gafac RA600 (Rhone-Poulenc Surfactant and Specialty Div.), Pluronic L-61 (BASF Corp.), Pluronic L64 (BASF Corp.) and Avanel N-1535 (PPG/Mazer). These surfactants and others of the chemical types mentioned in Example VI were added to the solutions described in Examples I-III in a concentration of from 0.01-5.0% W/V either singularly or in combination with one another.

Electronic components with resin-bleed covering the leads were immersed in the above solutions and made the cathode in an electrical circuit. After removal from the solutions all component leads were found to be free of resin-bleed. The particular improvement found by adding surfactant or detergent materials results in a reduction of the time required to remove resin-bleed from the electronic component lead. This is of particular importance when these solutions are used in an automatic cleaning machine wherein the cleaning step is limited to a finite time often measured in seconds.

EXAMPLE VII

A bath described Example I was prepared:

| | |
|---|---|
| Dipotassium phosphate | 80 g/l |
| Water | Balance |

To this solution was added a quantity of glycerol (1,2,3 propanetriol) ranging from 5-20% W/V. An electronic component with leads covered with resin-bleed was made the cathode in an electrical circuit and immersed in the above solution. After a short time the electronic leads were found to be clean and particularly smooth. It is believed that the addition of such an aliphatic polyalcohol provides additional protection to the material leads at such time as the resin bleed plastic material is removed from the metal surface. Examination of a number of electronic component leads cleaned in such a solution showed leads that were uniformly smooth.

EXAMPLE VIII

While for the most part, the cleaning solutions of Examples I-III are operated in the pH range of 7-10, there may be certain substrates and resin bleed which are more effectively removed in a cleaning solution operated in a different pH region and such solution has the added benefit of reducing or removing oxides without electrical current.

Accordingly, the solutions of Example I-III were adjusted to a pH region of 0.1-7 more preferably 0.1-4.0 with either sulfuric or phosphoric acid either singularly or in combination with certain aliphatic acids or their salts such as for example but not limited to methanesulfonic, glycolic, lactic, citric, malic, maleic, succinic, propionic, gluconic or glucoheptonoic. Electronic components with leads contaminated with resin-bleed were immersed in a cleaning solution of Example I which has been further modified by the addition of certain acids described previously either singularly or in combination to a pH of 0.1-7 and made the cathode in an electrical circuit. After a short time the electronic components were removed from the cleaning solution and the lead areas were found to be free of resin bleed.

As a further benefit it was found that the time required to reduce metal oxides on the lead surface was reduced by operating the cleaning bath in the pH region 0.1–7.0.

The following are specific solutions to which an acid was added:

| | | |
|---|---|---|
| A) | Dipotassium phosphate | 80 g/l |
| | Phosphoric acid | 30 g/l |
| | Water | Balance |
| B) | Ammonium phosphate | 100 g/l |
| | Sulfuric acid | 30 g/l |
| | Glycolic acid | 20 g/l |
| | Water | Balance |
| C) | Dipotassium phosphate | 80 g/l |
| | Phosphoric acid | 15 g/l |
| | Citric acid | 10 g/l |
| | Water | Balance |
| D) | Ammonium phosphate | 100 g/l |
| | Sulfuric acid | 40 g/l |
| | Methanesulfonic acid | 10 g/l |
| | Water | Balance |
| E) | Potassium pyrophosphate | 140 g/l |
| | Phosphoric acid | 20 g/l |
| | Lactic acid | 15 g/l |
| | Water | Balance |

EXAMPLE IX

While for the most part Examples I–III are operated in the pH range 7–10 there may be certain substrates and resin-bleed covered leads which are more effectively cleaned in a solution operated in a pH region in excess of 10. It is well known in the art of metal cleaning that alkaline cleaning, either soak or electrocleaning, is a preferred method of cleaning metals.

Accordingly, the solutions of Examples I–III were adjusted to a pH in excess of 10 with either alkali metal hydroxide, ammonium hydroxide or aliphatic hydroxides singularly or in combination. Electronic components with leads covered with resin-bleed were immersed in the cleaning solutions whose pH were adjusted in excess of 10. The electronic components leads were made the cathode in an electrical circuit. After a short time the electronic component was removed from the cleaning solution and the leads were found to be completely free of resin-bleed.

| | | |
|---|---|---|
| A) | Dipotassium phosphate | 80 g/l |
| | Potassium hydroxide | 20 g/l |
| | Water | Balance |
| B) | Ammonium phosphate | 100 g/l |
| | Ammonium hydroxide | 30 g/l |
| | Tetramethylammonium hydroxide | 10 g/l |
| | Water | Balance |
| C) | Potassium pyrophosphate | 140 g/l |
| | Sodium hydroxide | 30 g/l |
| | Water | Balance |
| D) | Dipotassium phosphate | 80 g/l |
| | Potassium hydroxide | 20 g/l |
| | 2 hydroxyethyltrimethyl ammonium hydroxide | 10 g/l |
| | Water | Balance |

While the foregoing invention has been described with reference to its preferred embodiments, various alternation and modifications will occur to those skilled in the art. All such alterations and modifications are intended to fall within the scope of the claims.

What is claimed is:

1. A process for removing resin-bleed from leads of an encapsulated electronic component comprising the steps of:

positioning said electronic component in an aqueous bath;

aqueous bath having dissolved therein glycerol and a phosphate salt selected from the group consisting of an alkali metal, or ammonium phosphate, polyphosphate or pyrophosphate salt in an amount sufficient to impart conductivity to said bath;

making the leads of the component act as a cathode in an electrical circuit;

passing electrical current through said electronic component.

2. The process of claim 1 wherein said alkali metal or ammonium phosphate, polyphosphate or pyrophosphate salt is selected from the group consisting of phosphate, metaphosphate, hexametaphosphate, orthophosphate, polyphosphate, phosphate dibasic, phosphate monobasic, phosphate tribasic, pyrophosphate tetrabasic, tripolyphosphate, all either as the anhydrous or hydrated form.

3. The process of claim 1 where said phosphate is present in said bath in an amount between 0.1 weight percent and 50 percent.

4. The process of claim 1 wherein said bath further comprises a surfactant or detergent selected from a group consisting of octyl or nonyl phenoxy polyethoxy ethanols, phosphate ester types, amine polyglycol condensates, alkyl aryl polyether alcohols, modified polyglycol adducts, modified polyethoxylated alcohol, ethoxylated linear alcohols substituted imidazoline carboxylates, chloroblocked copolymers of ethylene and propylene oxide and poly (oxypropylene) block copolymers, said surfactants or detergents being used at a concentration of between 0.01 and 5.0% by weight either singularly or in combination with one another.

5. The process of claim 1 wherein such bath further comprises an inorganic acid to adjust operating pH to between a range of 0.1 to 7 and more preferably between 0.1 and 4.0.

6. The process of claim 5 wherein said inorganic acids may be selected from the group of sulfuric or phosphoric acids.

7. The process of claim 5 wherein such aliphatic organic acids or salts of aliphatic organic acids may be selected from the group of: methanesulfonic, glycolic, lactic, citric, malic, maleic, succinic, propionic, gluconic and glucoheptonoic acids.

8. The process of claim 1 wherein said bath further comprises aliphatic organic acids or salts of aliphatic organic acids.

9. The process of claim 1 wherein said bath further comprises an alkali metal or ammonium hydroxide to adjust operating pH in excess of 10.0 and an aliphatic hydroxide or ammonia.

10. The process of claim 9 wherein said alkali metal or hydroxide is selected from the group of sodium hydroxide, potassium hydroxide, ammonium hydroxide and mixtures thereof.

11. The process of claim 9 wherein said aliphatic hydroxide is tetramethyl ammonium hydroxide or 2 hydroxyethyltrimethyl ammonium hydroxide.

12. The process of claim 1 wherein said bath is used in a temperature range from 60° F. to 212° F.

13. A solution for use in removing resin-bleed from leads of an encapsulated electronic component the leads of which act as a cathode as the component is passed through said solution, said solution comprising an aqueous bath having dissolved therein glycerol and an alkali metal or ammonium phosphate, polyphosphate or pyrophosphate salt in an amount sufficient to impart conductivity to said bath.

14. The solution of claim 13 wherein said alkali metal or ammonium phosphate, polyphosphate or pyrophosphate salt is selected from the group consisting of phosphate, metaphosphate, hexametaphosphate, orthophosphate, polyphosphate, phosphate dibasic, phosphate monobasic, phosphate tribasic, pyrophosphate tetrabasic, tripolyphosphate, all either as the anhydrous or hydrated form.

15. The solution of claim 13 where said phosphate is present in said bath in an amount between 0.1 weight percent and 50 percent.

16. The solution of claim 13 wherein said bath further comprises a surfactant or detergent selected from a group consisting of octyl or nonyl phenoxy polyethoxy ethanols, phosphate ester types, amine polyglycol condensates, alkyl aryl polyether alcohols, modified polyglycol adducts, modified polyethoxylated alcohol, ethoxylated linear alcohols substituted imidazoline carboxylates, chloroblocked copolymers of ethylene and propylene oxide and poly (oxypropylene) block copolymers, said surfactants or detergents being used at a concentration of between 0.01 and 5.0% by weight either singularly or in combination with one another.

17. The solution of claim 13 wherein such bath further comprises a linear or branched, aliphatic polyalcohol.

18. The solution of claim 17 wherein such aliphatic polyalcohol is glycerol.

19. The solution of claim 13 wherein such bath further comprises an inorganic acid to adjust operating pH to between a range of 0.1 to 7 and more preferably between 0.1 and 4.0.

20. The solution of claim 19 wherein said inorganic acids may be selected from the group of sulfuric or phosphoric acids.

21. The solution of claim 19 wherein such aliphatic organic acids or salts of aliphatic organic acids may be selected from the group of: methanesulfonic, glycolic, lactic, citric, malic, maleic, succinic, propionic, gluconic and glucoheptonoic acids.

22. The solution of claim 13 wherein said bath further comprises aliphatic organic acids or salts of aliphatic organic acids.

23. The solution of claim 13 wherein said bath further comprises an alkali metal or ammonium hydroxide to adjust operating pH in excess of 10.0.

24. The solution of claim 23 wherein said alkali metal or hydroxide is selected from the group of sodium hydroxide, potassium hydroxide, ammonium hydroxide and mixtures thereof.

25. The solution of claim 23 wherein said bath further comprises an aliphatic hydroxide or ammonia.

26. The solution of claim 25 wherein said aliphatic hydroxide is tetramethyl ammonium hydroxide or 2 hydroxyethyltrimethyl ammonium hydroxide.

27. The solution of claim 13 wherein said bath is used in a temperature range from 60° F. to 212° F.

28. A solution for use in removing resin-bleed from leads of an encapsulated electronic component the leads of which act as a cathode as the component is passed through said solution, said solution comprising an aqueous bath having dissolved therein (a) an aliphatic hydroxide or ammonia and (b) an alkali metal or ammonium phosphate, polyphosphate or pyrophosphate salt in an amount sufficient to impart conductivity to said bath.

29. The solution of claim 28 wherein said aliphatic hydroxide is tetramethyl ammonium hydroxide or 2 hydroxyethyltrimethyl ammonium hydroxide.

* * * * *